US007270198B2

(12) United States Patent
Camp

(10) Patent No.: US 7,270,198 B2
(45) Date of Patent: Sep. 18, 2007

(54) ORIENTER FOR DRILLING TOOL ASSEMBLY AND METHOD

(75) Inventor: David Camp, Cypress, TX (US)

(73) Assignee: American Kinetics, Inc.

( * ) Notice: Subject to any disclaimer, the term of this patent is extended or adjusted under 35 U.S.C. 154(b) by 0 days.

(21) Appl. No.: 10/731,496

(22) Filed: Dec. 9, 2003

(65) Prior Publication Data

US 2005/0023037 A1 Feb. 3, 2005

Related U.S. Application Data

(60) Provisional application No. 60/431,891, filed on Dec. 9, 2002.

(51) Int. Cl.
*E21B 7/08* (2006.01)

(52) U.S. Cl. ..... 175/61; 175/73; 175/26; 175/45; 175/75

(58) Field of Classification Search ..... 175/26, 175/45, 61, 73, 75
See application file for complete search history.

(56) References Cited

U.S. PATENT DOCUMENTS

| | | | | |
|---|---|---|---|---|
| 4,901,804 | A * | 2/1990 | Thometz et al. | 175/40 |
| 5,139,094 | A * | 8/1992 | Prevedel et al. | 175/61 |
| 5,738,178 | A * | 4/1998 | Williams et al. | 175/61 |
| 6,129,160 | A * | 10/2000 | Williams et al. | 175/107 |
| 6,158,529 | A * | 12/2000 | Dorel | 175/61 |
| 6,550,818 | B2 * | 4/2003 | Robin | 285/184 |
| 6,571,888 | B2 * | 6/2003 | Comeau et al. | 175/61 |
| 6,679,323 | B2 * | 1/2004 | Vargervik et al. | 166/55.1 |
| 2001/0052428 | A1 * | 12/2001 | Larronde et al. | 175/61 |

* cited by examiner

*Primary Examiner*—William Nauder
*Assistant Examiner*—Nicole A Coy

(57) ABSTRACT

The disclosed orienter for use in drilling a subterranean borehole enables use of the torque provided by the drilling motor to both orient the rotating drill bit for drilling an arcuate section of the borehole and rotating the orienter housing, including a fixed bend for drilling a straight section of the borehole.

7 Claims, 3 Drawing Sheets

ORIENTER FOR DRILLING TOOL ASSEMBLY AND METHOD

REFERENCE TO RELATED APPLICATION

This application claims priority from U.S. Provisional Patent Application Ser. No. 60/431,891 filed Dec. 9, 2002.

FIELD

The disclosed invention generally relates to equipment for drilling boreholes beneath and generally parallel to the earth's surface; more particularly, the present invention pertains to equipment for providing power to and directing the path of a rotating drill bit. While the present invention is described herein with respect to shallow depth boreholes drilled for utility line installation, those of ordinary skill in the art will understand that the disclosed invention may be used in any type of coiled tubing drilling operation to include deep hole drilling for water, oil, or natural gas.

BACKGROUND

In the installation of utility or transmission lines, the practice of drilling directionally controlled, generally horizontal, boreholes through the earth at generally shallow depths beneath the earth's surface has gained increasing acceptance. The combination of equipment to drill generally horizontal or directional boreholes is built around a downhole drilling motor apparatus, often called a mud motor, which is used for rotating the drill bit which cuts through soil and rock. While the disclosed orienter of the present invention is shown mounted to the downhole end of coiled tubing as shown in U.S. Pat. No. 6,536,539 to the same assignee, it may also be used on the downhole end of a continuous non-rotating string of pipe segments.

To control the direction at which a generally horizontal borehole is drilled for utility line installation, some type of orienter is typically provided to direct the travel of the rotating drill bit along the desired path. Following the desired path may begin by requiring the rotating drill bit to first penetrate the earth's surface at a shallow angle, bore downwardly to a predetermined depth, then level out, then possibly direct the rotating drill bit to turn downward to move deeper, or possibly direct the rotating drill bit to turn to one side to avoid an obstacle, or to move along a more direct path toward a predetermined target, then finally, to turn upward to return back to the earth's surface.

In the art of drilling subterranean, substantially horizontal or directional boreholes with a rotating drill bit powered by a motor and advanced through the borehole by coiled tubing, there typically exists a need to position or direct a fixed bend or angle built into the downhole mounting for the rotating drill bit to facilitate directing the path of the borehole in something other than a straight line.

Various prior art drilling tool assemblies have been developed to cause a rotating drill bit to form a borehole whose path follows something other than a straight line. These prior art drilling tools utilize a variety of technologies to control the direction of the rotating drill bit and thus the path of the completed borehole. Some of the technologies for controlling the direction of the rotating drill bit include: a) pressure activated positioners, which operate independently to index the position of a downhole mud motor having a housing with a fixed bend, to a desired position; b) pressure activated tools which operate independently to create a "kick" or a temporary bend at a specific location, when activated by a predetermined signal; c) activated deflection shoes which independently operate to engage one side or face of the borehole, somewhere behind the cutting face of the rotating drill bit, to push the cutting tool face off to one side; and d) rotary tools which either allow the drilling motor to be rotated to a desired position and then either locked into the desired position or which allow the drill motor to rotate constantly to provide a straight hole and then lock up on command when directional drilling is required. All of the devices which implement these technologies to form a borehole following something other than a straight line are commonly referred to as "orienters." In addition, prior art orienters typically require a separate source of power and control mechanism for redirecting the mounting apparatus for the rotating drill bit from a configuration which forms a bore hole following a straight line to a configuration which forms a bore hole following something other than a straight line, typically a shallow arc.

Generally, in subterranean shallow depth prior art coiled tubing drilling operations, the drilling tool assembly mounted to the end of a length of non-rotating coiled tubing includes: a rotating drill bit, preceded by a hydraulic motor assembly. The hydraulic motor assembly is typically housed in a long tube. Rotation of the motor is caused by the flow of drilling mud (typically called a "mud" motor). Above the mud motor, closer to the end of the coiled tubing, is a steering tool (or mechanism capable of tracking and reporting on the geometry of the path of the completed borehole). Above the steering tool and generally connected to the end of the coiled tubing is the orienter (a tool capable of changing the direction in which the rotating drill bit is pointed as it forms a subterranean shallow depth borehole). The coiled tubing connected to the orienter provides the linear force at the proximal end of the drilling tool assembly. It is this linear force which moves the drilling tool assembly through the borehole as the rotating drill bit cuts through the soil and rock at the drill face in contact with the rotating drill bit at the distal end of the drilling tool assembly.

The rotating drill bit is turned by the torque provided by the mud motor. The combination of the continuous rotary motion and the hardened projections on the end of the rotating drill bit enable the rotating drill bit to cut through soil and rock and thereby create a subterranean borehole. The mud motor produces the rotary power or torque needed to turn the drill bit by converting the energy from the flow of fluid or drilling mud, which is pumped through the mud motor, into rotary power or torque.

The steering tool, which is typically positioned behind or above the mud motor, provides signals which are used to track the path of the borehole, formed by a combination of straight and arcuate borehole segments.

The orienter portion of the drilling tool assembly is used to provide the necessary physical movements to position the entire drilling tool assembly to alter the path of the borehole by causing the drilling tool assembly to create a straight line segment or to create an arcuate segment.

In some prior art directional drilling systems, the drive shaft portion of the drilling motor is coupled to a swivel type joint or CV type joint at a point in the motor housing which includes a fixed bend. This construction allows for an oscillating rotation of the drive shaft in a conical fashion. Also, common in some prior art drilling tool assemblies, the orienter portion includes an array of thrust bearings and seals to properly displace and transmit the forces which determine the path of the borehole.

The geometry of the combination of the straight and arcuate segments at predetermined locations within the completed borehole is dictated, in part, by the bend in the mud motor housing. To create a straight segment of a borehole, the orienter facilitates either continuously rotating the drill and the bent portion of its mounting, or the orienter periodically moves one or more components in the drilling tool assembly to form an arrangement which will produce a substantially straight borehole segment.

To create an arcuate segment of a borehole, the orienter typically does not allow the bent portion of the drill bit mounting to rotate, thereby enabling the fixed bend portion of the mud motor housing to create an arcuate segment of the borehole. Available orienters for use with drilling tool assemblies feature a multitude of designs and functions. The device disclosed in U.S. Pat. No. 5,215,151, to Smith is illustrative of a drilling tool assembly including a fixed bend.

To monitor the position of the drilling tool assembly and the orientation of the rotating drill bit, a variety of different techniques have been utilized. Some systems utilize radio beacon transmitters located within the steering tool portion of the drilling tool assembly. This is known as a sonde housing. The radio signals from the transmitter in a sonde housing may be received either by using a walkover receiver or by using a wireline which follows the drilling tool assembly into the borehole. The radio signals provide necessary information about the position of the drilling tool assembly and the orientation of the rotating drill bit. Such rotating drill bit orientation information may include: clock face position, pitch, roll, yaw, and azimuth. With the information about the position of the drilling assembly and the orientation of the rotating drill bit, the operator may control the direction of the path of the borehole.

As the sophistication of coiled tubing drilling applications has progressed and new drilling tools are tested and operated, certain procedures have been found to be more conducive to drilling generally horizontal or directional boreholes with coiled tubing. As previously indicated, the drilling of boreholes for the installation of utility or transmission lines typically includes causing the drilling tool assembly to first penetrate the ground surface at a shallow angle, then move to a predetermined depth, then traverse a generally horizontal predetermined path to travel under or around obstacles, and finally to move upwardly to exit the ground surface at a shallow angle some distance away. In such prior art drilling operations for the installation of utility lines, the entire drilling tool assembly (in some cases the rotating drill bit, the motor together with its housing, the steering tool, and the orienter can be as much as ten feet long) must completely exit the ground to be removed from the end of the coiled tubing. Simply because of the extended length of the drilling tool assembly, the process of removing the entire drilling tool assembly from the end of the coiled tubing can be quite cumbersome. Accordingly, it is desirable to develop an orienter for a drilling tool assembly that is simpler in construction, reduces the length of the drilling tool assembly, and reduces the power requirements without detracting from the functionality of the prior art orienters used in drilling tool assemblies.

There remains, therefore, in the art a need for a new system and method to orient a drilling tool assembly which simplifies the construction of the drilling tool assembly, shortens the length of the overall drilling tool assembly, and either minimizes the power required for orientation of the drilling tool assembly or eliminates the need for a separate power source to perform the orienting function.

SUMMARY

The disclosed orienter is simpler in construction, shorter than orienters found in the prior art, and reduces power requirements while maintaining the capabilities of prior art systems for drilling substantially horizontal or directional boreholes.

By changing the location of the orienter with respect to the other parts of a drilling tool assembly, the construction of the drilling tool assembly is simplified and the length of the drilling tool assembly is greatly reduced.

The disclosed preferred embodiment of the orienter is best described as a device operated by the torque produced by the drilling motor. The drive shaft which carries the torque produced by the drilling motor is enclosed in the internally driven, rotatable, external fixed bend housing of the orienter. When the internal clutch mechanism is engaged, the rotatable, external fixed bend housing of the orienter uses the torque from the drilling motor to rotate the external fixed bend housing, while at the same time causing the rotating drill bit to turn. This configuration creates a straight line section of the borehole. The rotatable, external, fixed bend housing is only disengaged from the drive shaft portion of the drilling motor when it is desired to create an arcuate section of the borehole. In this configuration, the external housing does not turn, and the housing is indexed or selectively rotated by the motor to a position in which the fixed bend directs the rotating drill bit along an arcuate path.

When the internal clutch mechanism is engaged, the rotatable, external fixed bend portion of the drilling motor housing receives rotational torque from the drive shaft portion of the drilling motor. By using the rotational torque from the drive shaft of the drilling motor, no additional separate drive mechanism is required to be placed into the drilling tool assembly for orienting the rotating drill bit within the borehole. An electrical, hydraulic, or mechanical signal is used to activate the internal clutch mechanism. This engagement of the clutch mechanism transmits the torque from the drive shaft portion of the drilling motor to the rotatable, external, fixed bend housing.

The upper section of the rotatable, external, fixed bend housing includes a speed reduction or torque conversion system. A clutch mechanism is attached to this internal speed reduction or torque conversion system. It is the speed reduction or torque conversion system which reduces the rotational speed of the drive shaft from the drill motor to an acceptable final output rpm for the external, rotatable housing.

BRIEF DESCRIPTION OF THE DRAWING FIGURES

A better understanding of the orienter of the present invention may be had by reference to the drawing figures, wherein.

DESCRIPTION OF THE EMBODIMENTS

Figure 1:
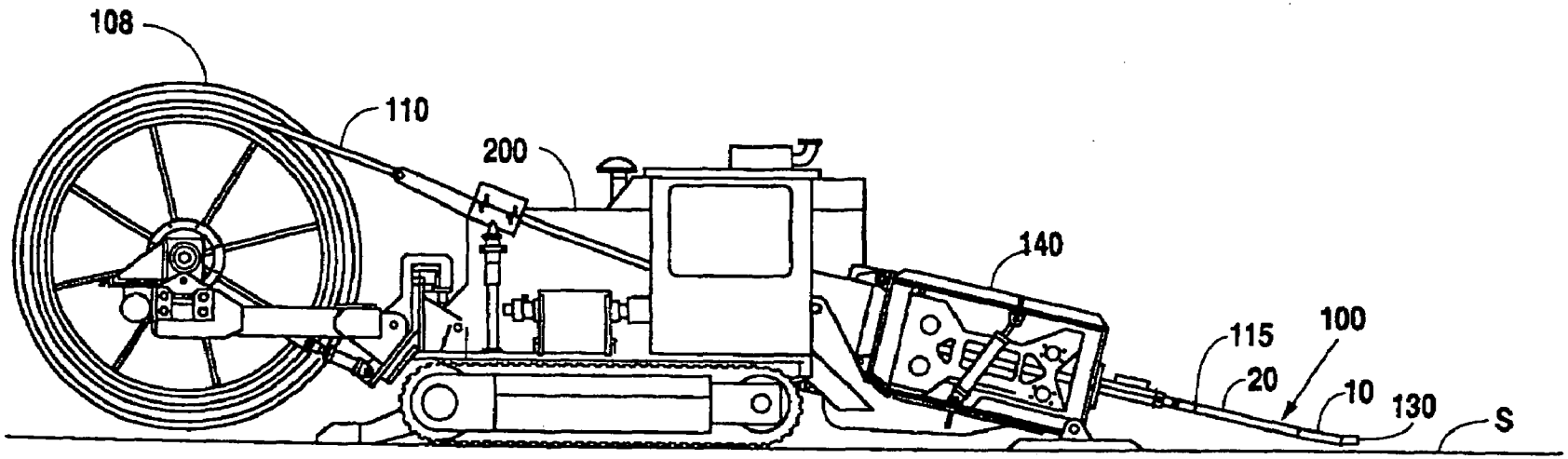
FIG. 1 is a side elevational view of a system for drilling subterranean, shallow depth, substantially horizontal boreholes using coiled tubing.

The orienter 10 of the present invention is attached to the drilling motor assembly 20 portion of a drilling tool assembly 100. The motor assembly 20 portion is used primarily for turning a rotating drill bit 130. By repositioning the orienter assembly 10 of the present invention to a different location within the drilling tool assembly 100 than is found in prior art drilling tool assemblies, the construction of the drilling tool assembly is simplified and its overall length is reduced. This simplified construction and reduced length makes a drilling tool assembly 100 incorporating the orienter 10 of the present invention easier to use by eliminating the logistical issues and special job site planning considerations associated with more complex, longer length prior art drilling tool assemblies.

As may be seen in FIG. 1, the orienter 10 of the present invention is used in a drilling tool assembly 100 which is mounted on the end 115 of a length of coiled tubing 110. The coiled tubing 110 is typically stored on a mobile platform 200 at the earth's surface. An injector assembly 140 connected to the mobile platform 200 grasps the coiled tubing 110 and exerts linear force thereon to move it through a subterranean borehole.

Figure 2:
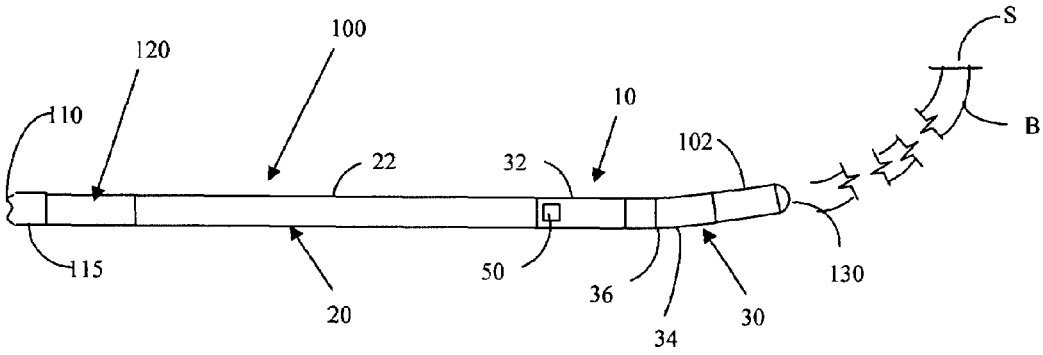
FIG. 2 is a side elevational schematic drawing of the arrangement of the key components in a drilling to assembly of the present invention, for drilling a subterranean borehole having an arcuate path.

As may be seen in FIG. 2, the disclosed orienter 10 forms a part of a drilling tool assembly 100. The drilling tool assembly 100 is designed and provided with the necessary hardware well known to those of ordinary skill in the art for mounting on the end of coiled tubing 110. Beginning at the end 115 of the coiled tubing 110 which connects to the drilling tool assembly 100, the drilling tool assembly 100 includes a steering tool assembly 120 for monitoring and tracking position of the drilling tool assembly 100 in the borehole B as it is being drilled. Mounted next to the steering tool assembly 120 is the drilling motor or mud motor assembly 20. The drilling motor or mud motor assembly 20 is a hydraulic motor which produces rotational power or torque from the flow of drilling fluid or drilling mud through fluid flow passages within the motor assembly 20. It is typically the motor assembly 20 which adds the greatest amount of length to the drilling tool assembly 100.

According to the present invention, the orienter assembly 10 of the present invention is positioned in front of the drilling motor assembly 20, just behind the rotating drill bit 130. The orienter assembly 10 includes a housing 30 which may be divided into an upper section 32 and a lower rotatable section 34. Finally, at the distal end 102 of the drilling tool assembly 100 is the rotating drill bit 130. It is the rotating drill bit 130 which actually cuts through the soils and the rock to form the subterranean borehole B. Linear force transmitted to the drilling tool assembly 100 by the force placed on the coiled tubing 110 by the injector assembly 140. The linear force moves the rotating drill bit 130 forward as the rotating drill bit 130 cuts through the soil and rock at the drill face at the end of the borehole.

In FIG. 2 the lower rotatable section 34 is held fast; that is, it does not rotate. Accordingly, the fixed bend 36 in the lower rotatable section 34 of the orienter 10 causes the rotating drill bit 130 to form an arcuate segment of the borehole B. As shown in exaggerated manner in FIG. 2, if the fixed bend 36 is in a substantially vertical plane, the drilling tool assembly 100 will form an arcuate segment of the borehole B which tracks upwardly to the earth's surface S, thereby allowing for removal of the drilling tool assembly 100 from the end 115 of the coiled tubing 110 after the drilling tool assembly 100 exits the borehole.

Figure 3:
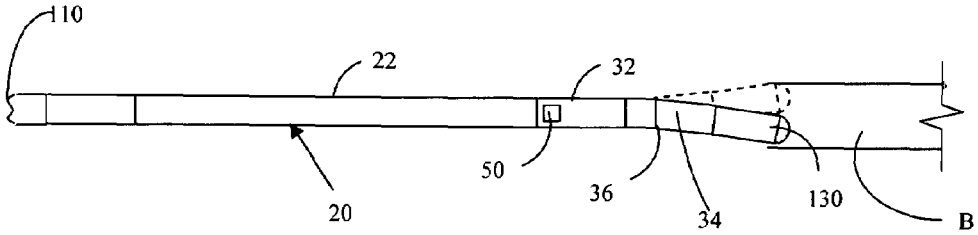
FIG. 3 is a side elevational schematic drawing of the oscillating action of the drilling tool assembly for drilling a borehole having a straight path.

In contrast, the lower rotatable section 34, shown in FIG. 3 is not held fast or in a fixed position; instead it is allowed to turn. The turning of the lower rotatable section 34 , to include both the fixed bend 36, and the lower portion 34, with respect to the non-rotary housing 22 around the drilling motor 20, enables the rotating drill bit 130 to cut a straight line segment of a large borehole. The transfer of torque from the drive shaft 24 portion of the drilling motor assembly 20 to the upper section 32 causes the entire lower rotatable section 34 to turn as shown in FIG. 3.

In a macro sense, the housing 30 of the disclosed orienter 10 looks like an extension of the non-rotating housing 22 which surrounds the drill motor 20. However, housing 30 of the orienter 10 is separate from housing 22. This separation allows the external, lower rotatable section 34 with a fixed bend 36 to rotate constantly at a minimal rpm while the drill motor assembly 20 causes the rotating drill bit 130 to move straight ahead with an oscillating action and thereby form a straight segment of the borehole B, as shown in FIG. 3. Disengagement of the mechanical connection between the upper section 32 from the drive shaft 24 portion of the drill motor assembly 20 and the indexing of the lower rotatable section 34 to the desired clock face position has the effect of placing the rotating drill bit 130 in a directional or steering mode as shown in FIG. 2 because the fixed bend 36 in the external, lower rotatable section 34 does not rotate. However, because the drive shaft 24 of the drilling motor 20 is still connected to the rotating drill bit 130 by a universal joint or flexible coupling 26, and thusly, the orienter drive shaft 27, the rotating drill bit continues to turn.

Figure 4:
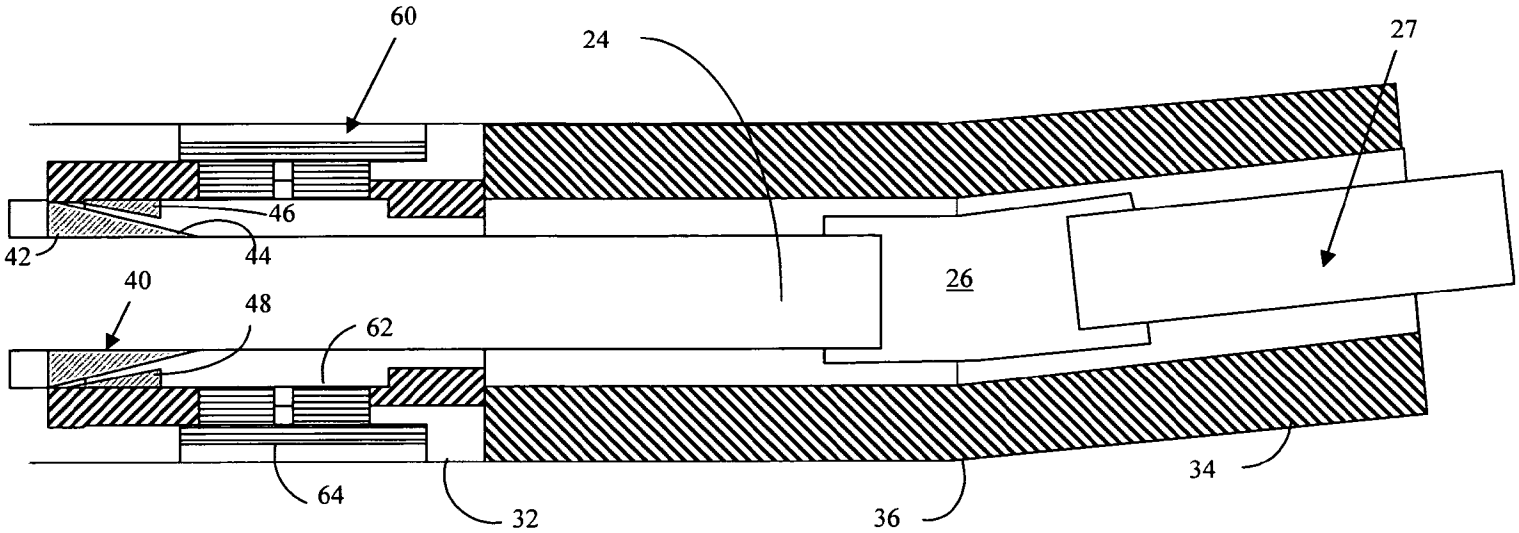
FIG. 4 is a side elevational schematic, in partial section, of the orienter of the present invention.

As shown in FIG. 4, the necessary drive force or rotational torque which causes the external, lower rotatable section 34 with a fixed bend 36 to turn is obtained from the drive shaft 24 of the drill motor assembly 20. In the preferred embodiment, connection of the external, lower rotatable section 34 with a fixed bend 36 to the drive shaft 24 of the drill motor 20 is accomplished by the use of a mechanical clutch mechanism 40.

The clutch mechanism 40 may be activated by a variety of different means to include an electrical, hydraulic, or mechanical signal. In the illustrated embodiment, the mechanical clutch mechanism 40 includes a first rotating tapered or wedge section 42 with an internal contact surface 44 which frictionally engages a second rotating tapered or wedge section 46 with an external contact surface 48. The frictional contact between internal surface 44 and the external contact surface 48 is sufficient to transmit rotational torque from the drive shaft 24 to the internal gear assembly 60. Those of ordinary skill in the art will understand that other types of mechanical clutch mechanisms or non-mechanical clutch mechanisms may be used without departing from the present invention. Such other clutch mechanisms may include electrical clutches and hydraulic clutches.

In the preferred embodiment, an internal gear assembly 60 within the upper section 32 is used. The internal gear assembly 60 includes a plurality of externally toothed spur gears 62. The rotation of the spur gears 62 causes rotation of the external housing 30 by engagement of a large-internally toothed ring gear 64 with the rotating spur gears 62. The gear ratio between the spur gears 62 and the ring gear 64 provides for a reduction in speed and an increase in torque. The end result is a circular movement of the lower rotatable section 34 including the fixed bend 36 and the rotating drill bit 130 to drill a straight borehole through soil and rocks. Those of ordinary skill in the art will understand that while a simple speed reduction gear train has been shown in the preferred embodiment, other speed reducing or torque mechanisms may be used without departing from the scope of the invention, to include but not limited to a hydraulic drive or a helical actuator.

To assure proper clock face position of the lower rotatable section 34 with respect to the non-rotating housing 22 surrounding the motor assembly 20 or torque transfer, a set of radially spaced contact points or similar radial position indicating systems, well known to those of ordinary skill in the art, may be used to provide a signal representative of the clock position of the lower rotatable section 34. As the lower rotatable section 34 is selectively rotated or indexed to a desired orientation by the motor 20, a single contact closes a circuit at a location representative of the clock face position of the lower rotatable section 34. The signal is received at the surface using a wireless transmission or a wire line. Knowledge of the clock face position of the lower rotatable section 34 enables the operator to assure that the fixed bend portion 36 of the orienter 10 is properly rotated or indexed to the desired orientation to create an arcuate segment of the borehole B which follows along a predetermined path.

Operation

A still better understanding of the orienter of the present invention may be had by an understanding of its method of operation.

Figure 5:
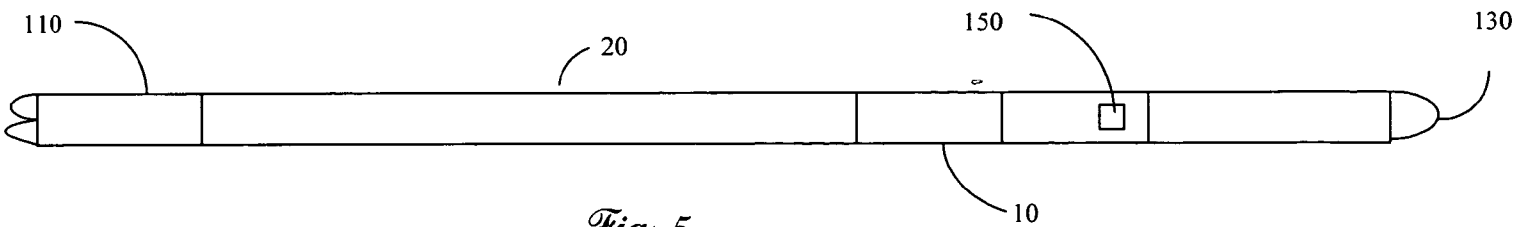
FIG. 5 is an alternate embodiment of the drilling tool assembly with the steering tool portion included in the orienter housing.

The system and method of the present invention is part of a drilling tool assembly 100 which typically governs the operation and direction of a rotating drill bit 130. As distinguished from prior art orienters, the orienter 10 is positioned next to the rotating drill bit 130. The combination of the drill bit 130, the orienter 10, and the mud motor assembly 20 is located on the end 115 of coiled tubing 110. Because the orienter 10 has been relocated to a position next to the rotating drill bit 130, it is now in a position where it can use the torque output of the mud motor assembly 20 rather than rely on a separate source of torque or rotary power. Those of ordinary skill in the art will also understand that while the conventional location for the steering tool assembly 120 which provides an indication of tool 100 location behind the motor assembly may be used, a steering tool assembly 150 may also be located inside of the lower rotatable section 34 or ahead of the mud motor assembly 20 as shown in FIG. 5.

The orienter 10 of the present invention may be used with it own indicators to provide position information if necessary or desired. Specifically, the disclosed orienter 10 will be capable of including a radio beacon transmitter 50 for wireless or wireline reporting of the position and orientation of the lower rotatable section 34.

Also, as previously indicated, the disclosed system and method allows for the orienter 10 to be placed ahead of or in front of the mud motor assembly 20. This arrangement simplifies construction and provides easier set up of drilling operations. In addition, this configuration enables the torque provided by the drilling motor 20 to both rotate the lower rotatable section 34 including the fixed bend 36 for either drilling a straight line portion of the borehole B or for rotating the housing to a desired clock face position for drilling an arcuate portion of the borehole B.

The preferred embodiment of the orienter 10 includes the use of a gear reduction system 60 driven by the output driveshaft 24 of the mud motor assembly 20 to both change the rotary speed and torque provided. The output driveshaft 24 of the mud motor assembly 20, when engaged with the housing 30, rotates the lower rotatable section 34 that contains the fixed bend 36. When desired, the gear reduction system 60 is disengaged from the output driveshaft 24 of the mud motor assembly 20 to cause the rotating drill bit 130 to create an arcuate borehole in a predetermined direction. The gear reduction system 60 can then be re-engaged to provide continuous rotation of the lower rotatable section 34, thereby facilitating drilling a straight segment of the borehole as shown in FIG. 3.

Observers of the entire system will see a large storage and spooling reel 108 containing a sufficient length of a continuous coiled tubing 110 to be injected and retracted from the borehole as shown in FIG. 1. The coiled tubing 110 is coupled to the storage and spooling reel 108. The spooling reel 108 contains a fluid swivel at its center portion to allow fluids to be pumped through the coiled tubing 110. An electrical wire, for communication of an electrical control signal or providing electrical power, may be inserted through the entire length of the coiled tubing 110 to provide access at the storage and spooling reel 108 for coupling to controls at the earth's surface using an electric swivel. The coiled tubing 110 is injected and retracted (pushed/pulled) by an injector assembly 140 that grasps the coiled tubing 110 and moves it in the desired direction.

The housing 22 containing the drill motor 20 itself does not contain a fixed bend section. Specifically, the drill motor assembly 20 is a straight mud motor known as a positive displacement motor or "monyo" style motor. The drill motor housing 22 abuts the leading end 115 of the coiled tubing 110 and is held in place by the coiled tubing 110 which resists the torque and tensile forces involved in the drilling process.

Typically, control of the orienter 10 requires communication of an electrical signal. This communication and any power required to actuate the clutch mechanism may be provided by an electrical wireline connection and pathway provided within the entire system. This pathway may either be fully inside the coiled tubing 110 and drilling tool assembly 100 or maintained on the outside of the coiled tubing 110 and drilling tool assembly 100.

Alternatively, wireless means may be used for control of the operation of the orienter 10. When a wireless control system is used, a transmitter and receiver may be used to communicate with each other, providing instructions for when to engage and disengage (rotate or go steer) the orienter 10. Such instruction can be implemented by installing a logic assembly in the orienter 10 that receives and sends data back and forth to a transmitter/receiver that is located in the coiled tubing 110 at the leading end of the tubing 105, above the mud motor 20.

Once the rotating drill bit 130 exits the ground, only the orienter portion 10 of the drilling tool assembly 100 need be pushed further out of the ground. If a back reaming tool powered by the mud motor is to be pulled back through the borehole, only the orienter 10 need be removed from the front of the mud motor assembly 20 to attach the back reamer.

Critical to the operation of the orienter 10 of the present invention is the amount of torque that is generated by the speed reduction or torque conversion system. In the preferred embodiment, the torque transferred by the internal gear reduction system 60 is determined by the design parameters of the gears 62, 64. To minimize the effect of torque on the gears 62, 64, two functions have been incorporated into the orienter 10. The first function is a built-in slip in the frictional power transfer engagement of the clutch mechanism 40. This built-in slip releases the drive shaft 24 at a given amount of excess torque to prevent damage. The second function is the basic design of the housing. Although it is imperative that the housing be robust enough to withstand the forces and the conditions encountered when drilling a borehole, the housing has also been designed to minimize the amount of resistance against the sides of the borehole to prevent a potential lag—which potential lag would be seen as increased torque load in the gear section.

While the present system and method has been disclosed according to the preferred embodiment of the invention, those of ordinary skill in the art will understand that other embodiments have also been enabled. Such other embodiments shall fall within the scope and meaning of the appended claims.

What is claimed is:

1. A drilling tool assembly comprising:

a steering system, a drilling motor, an orienter and, a drill bit, wherein said drilling motor includes a motor output shaft which provides output power to said drill bit;

wherein said orienter includes a first non-rotatable housing and a second rotable housing;

wherein said first non-rotatable housing surrounds a clutch mechanism and a speed reduction system;

wherein said clutch mechanism transmits rotary power from said motor output shaft to said speed reduction system, said speed reduction system located between said clutch mechanism and said second rotatable housing;

wherein said second rotatable housing includes a flexible coupling connecting said motor output shaft to an orienter drive shaft which is connected to said drill bit;

wherein said second rotatable housing further includes a bent portion surrounding said orienter drive shaft;

whereby when said clutch mechanism is actuated, rotary power from said motor output shaft is transmitted through said clutch mechanism, through said speed reduction system to rotate said second rotatable housing, while said orienter drive shaft continues to rotate said drill bit.

2. The drilling tool assembly as defined in claim 1 wherein;

said drilling tool assembly is constructed and arranged for mounting to the end of a length of coil tubing.

3. The drilling tool assembly as defined in claim 1 further including means for rotating said bent portion to a predetermined position.

4. The drilling tool assembly as defined in claim 1, wherein said clutch mechanism is a mechanical clutch which transmits torque using physical contact of surfaces.

5. The drilling tool assembly as defined in claim 1, further including a means for transmitting information describing the clock face position of said rotatable housing.

6. The drilling tool assembly as defined in claim 1 further including a steering guidance system means within said rotatable housing.

7. A method of directional drilling comprising using the drilling tool assembly of claim 1.

* * * * *